US008396223B2

(12) United States Patent
Moon et al.

(10) Patent No.: US 8,396,223 B2
(45) Date of Patent: Mar. 12, 2013

(54) METHOD AND AN APPARATUS FOR PROCESSING AN AUDIO SIGNAL

(75) Inventors: Jong Ha Moon, Seoul (KR); Hyen O Oh, Seoul (KR); Joon Il Lee, Seoul (KR); Myung Hoon Lee, Seoul (KR); Yang Won Jung, Seoul (KR)

(73) Assignee: LG Electronics Inc., Seoul (KR)

( * ) Notice: Subject to any disclaimer, the term of this patent is extended or adjusted under 35 U.S.C. 154(b) by 691 days.

(21) Appl. No.: 12/511,770

(22) Filed: Jul. 29, 2009

(65) Prior Publication Data

US 2010/0034394 A1 Feb. 11, 2010

Related U.S. Application Data

(60) Provisional application No. 61/084,267, filed on Jul. 29, 2008.

(51) Int. Cl.
*H04R 5/00* (2006.01)

(52) U.S. Cl. ..... 381/17; 381/104; 381/107; 381/89; 381/97

(58) Field of Classification Search ..... 381/1, 17–18, 381/97, 89, 104, 107, 109
See application file for complete search history.

(56) References Cited

U.S. PATENT DOCUMENTS

| | | | | |
|---|---|---|---|---|
| 3,772,479 | A * | 11/1973 | Hilbert | 381/18 |
| 5,978,490 | A | 11/1999 | Choi et al. | |
| 7,970,144 | B1 * | 6/2011 | Avendano et al. | 381/1 |
| 2002/0172378 | A1 | 11/2002 | Bizjak | |
| 2003/0123680 | A1 | 7/2003 | Lee et al. | |
| 2004/0111171 | A1 | 6/2004 | Jang et al. | |
| 2007/0076905 | A1 | 4/2007 | Konagai et al. | |
| 2007/0101249 | A1 | 5/2007 | Lee et al. | |
| 2008/0019533 | A1 | 1/2008 | Noguchi et al. | |
| 2008/0165286 | A1 * | 7/2008 | Oh et al. | 348/569 |
| 2009/0147961 | A1 | 6/2009 | Lee et al. | |

FOREIGN PATENT DOCUMENTS

| | | | |
|---|---|---|---|
| CN | 1898944 | A | 1/2007 |
| CN | 1898988 | A | 1/2007 |
| CN | 2938669 | A | 8/2007 |
| CN | 201015230 | A | 8/2007 |
| KR | 10-2004-0023084 | A | 3/2004 |
| KR | 10-2006-0007243 | A | 1/2006 |
| KR | 10-0648394 | B1 | 11/2006 |
| KR | 10-2007-0061100 | A | 6/2007 |
| WO | WO 2007/026025 | A2 | 3/2007 |
| WO | WO 2007/136187 | A1 | 11/2007 |

* cited by examiner

*Primary Examiner* — Disler Paul
(74) *Attorney, Agent, or Firm* — Birch, Stewart, Kolasch & Birch, LLP

(57) ABSTRACT

A method for processing an audio signal is disclosed. The present invention includes obtaining a stereophonic audio signal including a speech component signal and other component signals, obtaining gain values for each channel of the audio signal, determining whether the audio signal is an inverse-phase mono signal including left and right channel whose phase is inverted, inverting a phase of the obtained gain value corresponding to the one channel of the audio signal when the audio signal is an inverse-phase mono signal, modifying the speech component signal based on the inverted phase of the gain value, and generating a modified audio signal including the modified speech component signal, wherein the modified audio signal is in-phase mono signal. Accordingly, a volume of a speech signal of an inverse-phase audio signal and method thereof, in which a sign of a final gain value corresponding to one channel of the audio signal is changed or a value of the final gain corresponding to one channel of the audio signal is adjusted through a process for determining whether an input signal is an inverse-phase mono signal including left and right channel whose phase is inverted.

13 Claims, 8 Drawing Sheets

METHOD AND AN APPARATUS FOR PROCESSING AN AUDIO SIGNAL

CROSS-REFERENCE TO RELATED APPLICATION

This application claims the benefit of U.S. Provisional Applications No. 61/084,267, filed on Jul. 29, 2008 which is hereby incorporated by references.

BACKGROUND OF THE INVENTION

1. Field of the Invention

The present invention relates to an apparatus for independently controlling a volume of a speech signal extracted from an audio signal and method thereof, and more particularly, to an apparatus for independently controlling a volume of a speech signal by inverting a phase of a gain value corresponding to one channel of left and right channel whose phase is inverted and method thereof.

2. Discussion of the Related Art

Generally, an audio amplifying technology is used to amplify a low-frequency signal in a home entertainment system, a stereo system and other consumer electronic devices and implement various listening environments (e.g., concert hall, etc.). For instance, a separate dialog volume (SDV) means a technology for extracting a speech signal (e.g., dialog) from a stereo/multi-channel audio signal and then independently controlling a volume of the extracted speech signal in order to solve a problem of having difficulty in delivering speech in viewing a television or movie.

Generally, a method and apparatus for controlling a volume of a speech signal included in an audio/video signal enable a speech signal to be efficiently controlled according to a request made by a user in various devices for playing back an audio signal such as television receivers, digital multimedia broadcast (DMB) players, personal media players (PMP) and the like.

However, as phases of left and right channels signals are inverted due to such a cause as error in transmission or intentionally, if correlation between the left and right channel signals has a negative value despite a mono signal e.g., if an input signal is spread widely rather than concentrated on a specific point on sound), the corresponding signal is not recognized as a speech signal due to the characteristics of SDV algorithm. Therefore, it is unable to control a corresponding volume.

Meanwhile, operation of the SDV algorithm needs to be manually controlled according to a request made by a user, it may be inconvenient for the user to use the television receiver or the like.

SUMMARY OF THE INVENTION

Accordingly, the present invention is directed to an apparatus for independently controlling a volume of a speech signal extracted from an audio signal and method thereof that substantially obviate one or more of the problems due to limitations and disadvantages of the related art.

An object of the present invention is to provide an apparatus for independently controlling a volume of a speech signal of a inverse-phase audio signal and method thereof, in which a sign of a final gain value corresponding to one channel of the audio signal is changed or a value of the final gain corresponding to one channel of the audio signal is adjusted through a process for determining whether an input signal is an inverse-phase mono signal including left and right channel whose phase is inverted.

Another object of the present invention is to provide an apparatus for independently controlling a volume of a speech signal by automatically controlling a timing point of activating an SDV.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings:

FIG. 1 is a diagram for a process for playing back an audio signal via TV or the like;

DETAILED DESCRIPTION OF THE INVENTION

Reference will now be made in detail to the preferred embodiments of the present invention, examples of which are illustrated in the accompanying drawings. First of all, terminologies or words used in this specification and claims are not construed as limited to the general or dictionary meanings and should be construed as the meanings and concepts matching the technical idea of the present invention based on the principle that an inventor is able to appropriately define the concepts of the terminologies to describe the inventor's invention in best way. The embodiment disclosed in this disclosure and configurations shown in the accompanying drawings are just one preferred embodiment and do not represent all technical idea of the present invention. Therefore, it is understood that the present invention covers the modifications and variations of this invention provided they come within the scope of the appended claims and their equivalents at the timing point of filing this application.

Particularly, 'information' in this disclosure is the terminology that generally includes values, parameters, coefficients, elements and the like and its meaning can be construed as different occasionally, by which the present invention is non-limited.

A speech signal (particularly, dialog component) volume control technology according to the present invention may relate to an audio signal processing apparatus and method for modifying a speech signal in an inverse-phase mono signal environment in which phases of left and right channels are inverted due to error in transmission or intentionally. First of all, in the following description, an audio signal processing apparatus and method for modifying a speech signal in a general environment instead of an inverse-phase mono signal environment will be explained.

Figure 1:
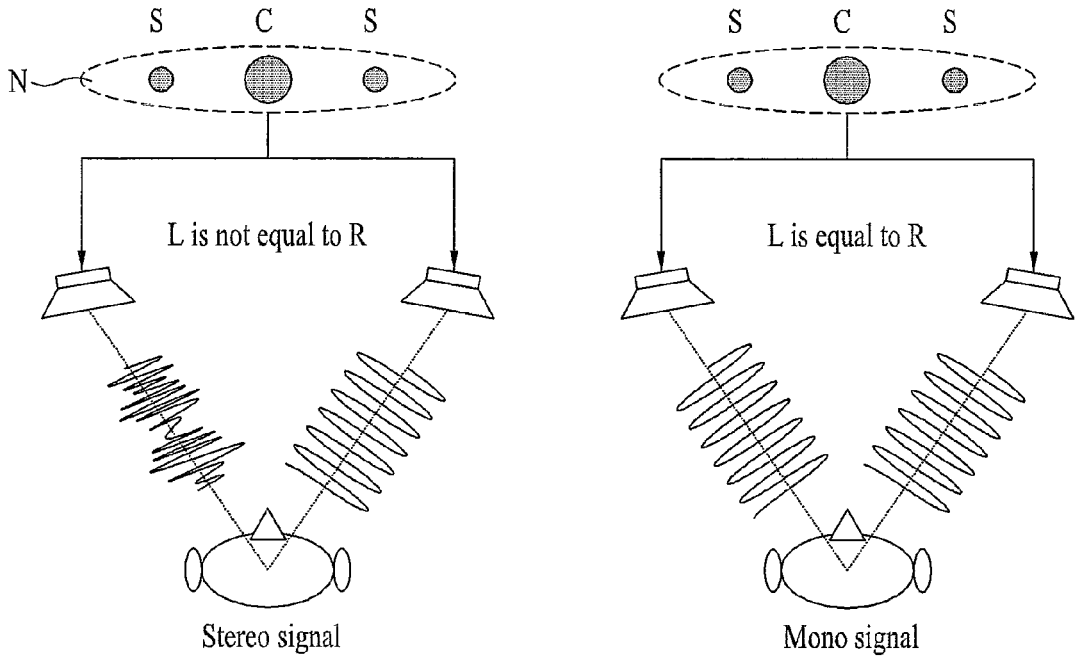

FIG. 1 is a diagram for a process for playing back an audio signal via TV or the like.

Referring to FIG. 1, a speech signal C is applied as an equal signal to left and right speakers and is then delivered to both ears of a listener trough a listening space where the viewer is located. In doing so, SDV extracts the speech signal C applied as the same signal to the left and right channels and then controls a volume of the extracted speech signal to be heard by a listener clearly or unclearly. In case of such a mono signal as news, when the SDV extracts the same signal from the left and right channel signals, a whole signal is extracted. When the SDV controls a speech signal, and more particularly, when a dialog volume is controlled, it brings an effect of controlling a whole volume.

Figure 2:
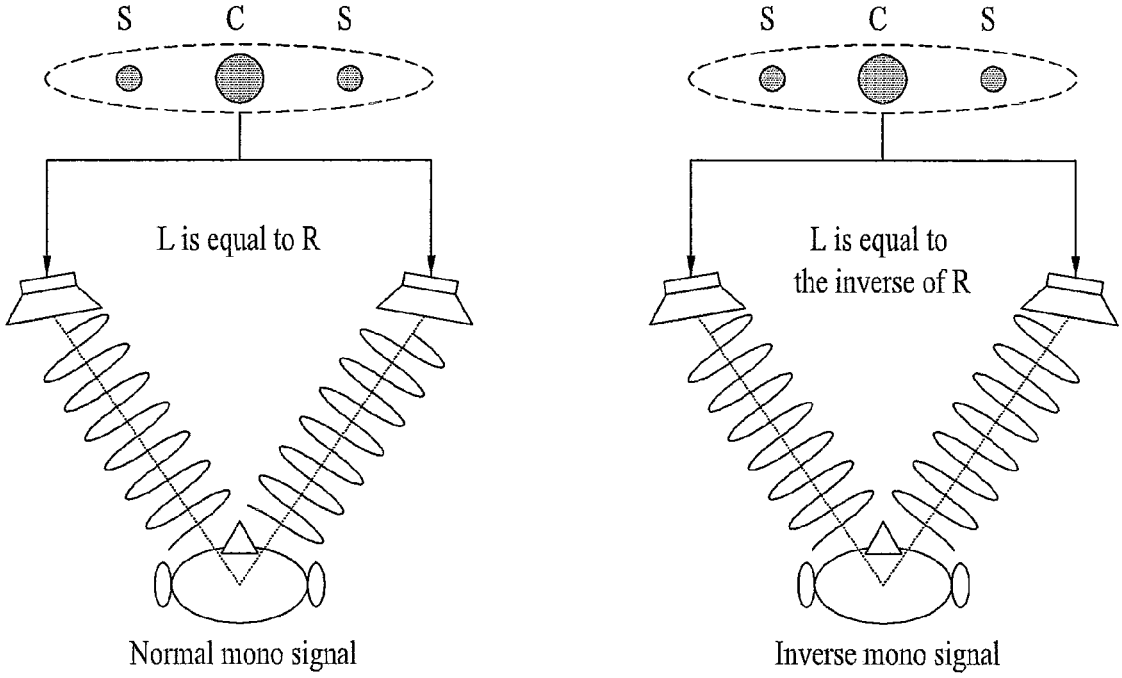
FIG. 2 is a diagram for a process for playing back an audio signal via a TV or the like in a general mono signal environment or an inverse-phase mono signal environment.

FIG. 2 is a diagram for a process for playing back an audio signal via a TV or the like in a general mono signal environment or an inverse-phase mono signal environment.

Referring to FIG. 2, powers and phases of left and right channel signals are equal in a general mono signal environment. Yet, in order to give a slight stereo effect to a mono signal environment of a specific broadcast, right left and right channel signal can be transmitted in a manner of phases of the left and right channel signals are inverted. This is called an inverse-phase mono signal environment. In this case, the inverse-phase mono signal environment can be made if a signal intentionally inverted by a broadcasting station is transmitted, if an erroneous signal attributed to error in transmission is transmitted, or if an original signal has this characteristic. In the inverse-phase mono signal environment, although left and right channel signals construct the same signal, since phases of the left and right signals are inverted, a general SDV fails to find the same component of the left and right channel signals. Hence, it is unable to extract any speech component at all.

Figure 3:
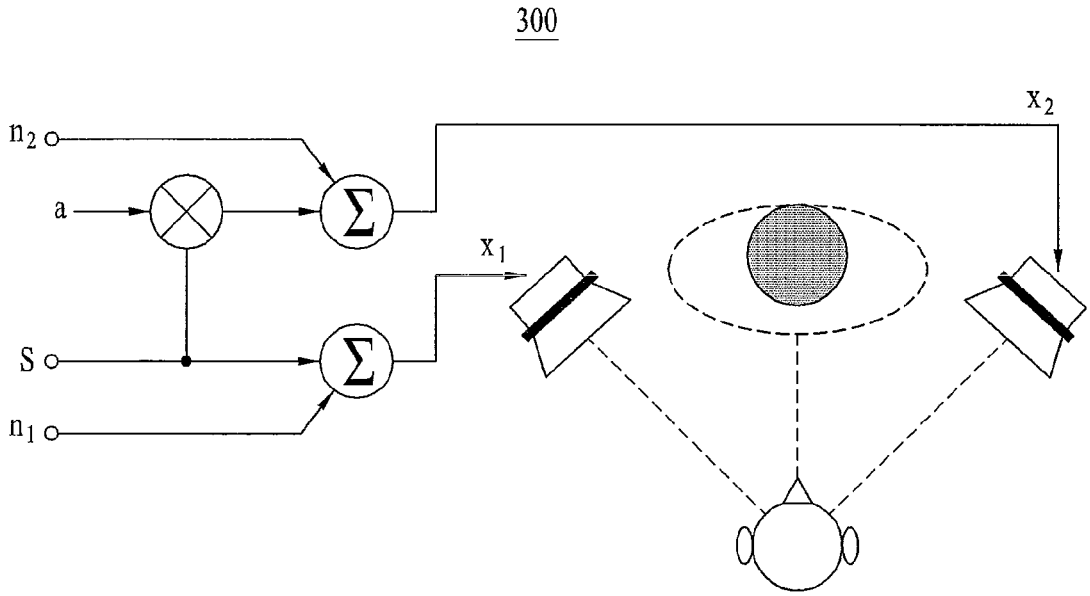
FIG. 3 is a diagram of a mixing model for a speech signal controlling technology.
Figure 4:
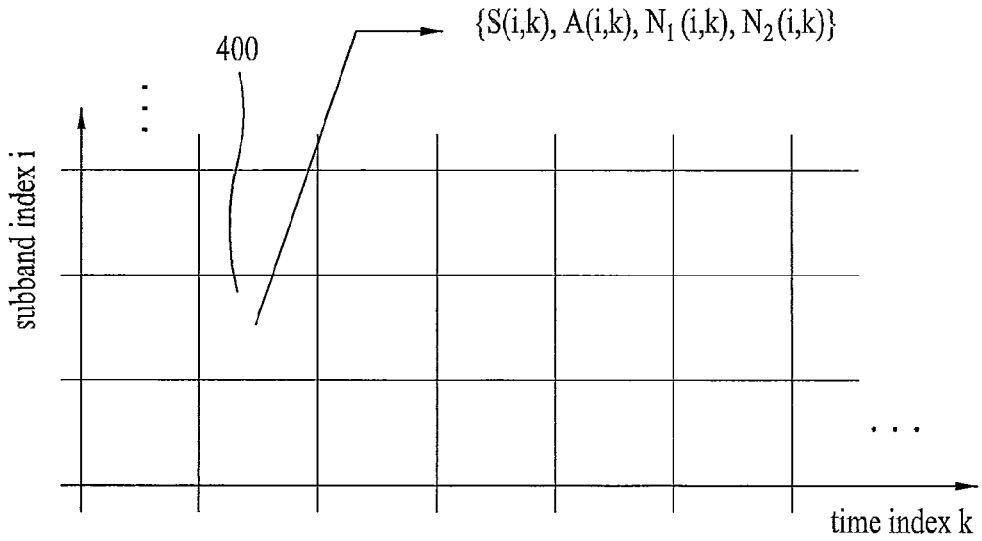
FIG. 4 is a graph of analysis of a stereo signal using time-frequency tiles.

FIG. 3 is block diagram of a mixing model 300 for dialog enhancement techniques. In the model 100, a listener receives audio signals from left and right channels. An audio signal s corresponds to localized sound from a direction determined by a factor a. Independent audio signals $n_1$ and $n_2$, correspond to laterally reflected or reverberated sound, often referred to as ambient sound or ambience. Stereo signals can be recorded or mixed such that for a given audio source the source audio signal goes coherently into the left and right audio signal channels with specific directional cues (e.g. level difference, time difference), and the laterally reflected or reverberated independent signals $n_1$ and $n_2$ go into channels determining auditory event width and listener envelopment cues. The model 300 can be represented mathematically as a perceptually motivated decomposition of a stereo signal with one audio source capturing the localization of the audio source and ambience.

$$x_1(n)=s(n)+n_1(n)$$

$$x_2(n)=as(n)+n_2(n) \qquad \text{[Formula 1]}$$

To get a decomposition that is effective in non-stationary scenarios with multiple concurrently active audio sources, the decomposition of [1] can be carried out independently in a number of frequency bands and adaptively in time $$X_1(i, k)=S(i, k)+N_1(i, k)$$

$$X_2(i, k)=A(i, k)S(i, k)+N_2(i, k), \qquad \text{[Formula 2]}$$

where i is a subband index and k is a subband time index.

FIG. 2 is a graph illustrating a decomposition of a stereo signal using time-frequency tiles. In each time-frequency tile 200 with indices i and k, the signals S, $N_1$, $N_2$ and decomposition gain factor A can be estimated independently. For brevity of notation, the subband and time indices i and k are ignored in the following description.

When using a subband decomposition with perceptually motivated subband bandwidths, the bandwidth of a subband can be chosen to be equal to one critical band. S, $N_1$, $N_2$, and A can be estimated approximately every t milliseconds (e.g., 20 ms) in each subband. For low computation complexity, a short time Fourier transform (STFT) can be used to implement a fast Fourier transform (FFT). Given stereo subband signals, $X_1$ and $X_2$, estimates S, A, $N_1$, $N_2$ can be determined. A short-time estimate of a power of $X_1$ can be donoted $$P_{x1}(i, k)=E\{X_1^2(i, k)\}, \qquad \text{[Formula 3]}$$

Where E{.} is a short-time averaging operation. For other signals, the same convention can be used, i.e., $P_{X2}$, $P_S$ and $P_N=P_{N1}=P_{N2}$ are the corresponding short-time power estimates. The power of $N_1$ and $N_2$ is assumed to be the same, i.e., it is assumed that the amount of lateral independent sound is the same for left and right channels.

Given the subband representation of the stereo signal, the power ($P_{X1}$, $P_{X2}$) and the normalized cross-correlation can be determined. The normalized cross-correlation between left and right channels is $$\Phi(i, k) = \frac{E\{X_1(i, k)X_2(i, k)\}}{\sqrt{E\{X_1^2(i, k)E\{X_2^2(i, k)\}}} \qquad \text{[Formula 4]}$$

A, $P_S$, $P_N$ can be computed as a function of the estimated $P_{X1}$, $P_{X2}$ and Φ. Three equations relating the known and unknown variables are:

$$P_{X1} = P_S + P_N \qquad \text{[Formula 5]}$$

$$P_{X2} = A^2 P_S + P_N$$

$$\Phi = \frac{aP_S}{\sqrt{P_{X1} P_{X2}}}.$$

Equantions [5] can be solved for A, $P_S$, and $P_N$, to yield $$A = \frac{B}{2C} \quad P_S = \frac{2C^2}{B} \quad P_N = X_1 - \frac{2C^2}{B}, \text{ with} \tag{Formula 6}$$

$$B = P_{X2} - P_{X1} + \sqrt{(P_{X1} - P_{X2})^2 + 4P_{X1}P_{X2}\Phi^2} \quad C = \Phi\sqrt{P_{X1}P_{X2}}. \tag{Formula 7}$$

Next, the least squares estimates of S, $N_1$, $N_2$ are computed as a function of A, $P_S$, and $P_N$. For each i and k, the signal S can be estimated as $$\hat{S} = w_1X_1 + w_2X_2 = w_1(S + N_1) + w_2(AS + N_2), \tag{Formula 8}$$

where $w_1$ and $w_2$ are real-valued weights. The estimation error is $$E=(1-w_1-w_2A)S-w_1N_1-w_2N_2. \tag{Formula 9}$$

The weights $w_1$ and $w_2$ are optimal in a least square sense when the error E is orthogonal to X1 and X2, i.e., $$E\{EX_1\}=0 \quad E\{EX_2\}=0, \tag{Formula 10}$$

yielding two equations $$(1-w_1-w_2A)P_S-w_1P_N=0 \quad A(1-w_1-w_2A)P_S-w_2P_N=0, \tag{Formula 11}$$

from which the weights are computed, $$w_1 = \frac{P_SP_N}{(A^2+1)P_SP_N + P_N^2} \quad w_2 = \frac{AP_SP_N}{(A^2+1)P_SP_N + P_N^2}. \tag{Formula 12}$$

The estimate of $N_1$ can be $$\hat{N}_1 = w_3X_1 + w_4X_2 = w_3(S + N_1) + w_4(AS + N_2). \tag{Formula 13}$$

The estimation error is $$E=(-w_3-w_4A)S-(1-w_3)N_1-w_2N_2. \tag{Formula 14}$$

Again, the weights are computed such that the estimation error is orthogonal to $X_1$ and $X_2$, resulting in $$w_3 = \frac{A^2P_SP_N + P_N^2}{(A^2+1)P_SP_N + P_N^2} \tag{Formula 15}$$

-continued $$w_4 = \frac{-AP_SP_N}{(A^2+1)P_SP_N + P_N^2}.$$

The weights for computing the least squares estimate of $N_2$, $$\hat{N}_2 = w_5X_1 + w_6X_2 = w_5(S + N_1) + w_6(AS + N_2), \tag{Formula 16}$$

are $$w_5 = \frac{-AP_SP_N}{(A^2+1)P_SP_N + P_N^2} \quad w_6 = \frac{P_SP_N + P_N^2}{(A^2+1)P_SP_N + P_N^2} \tag{Formula 17}$$

In some implementations, the least squares estimates can be post-scaled, such that the power of the estimates equals to $P_S$ and $P_N=P_{N1}=P_{N2}$. The power of $\hat{S}$ is $$P_{\hat{S}}=(w_1+aw_2)^2P_S+(w_1^2+w_2^2)P_N. \tag{Formula 18}$$

Thus, for obtaining an estimate of S with power $P_S$, $\hat{S}$ is scaled $$\hat{S}' = \frac{\sqrt{P_S}}{\sqrt{(w_1 + aw_2)^2P_S + (w_1^2 + w_2^2)P_N}}\hat{S}. \tag{Formula 19}$$

with similar reasoning, $\hat{N}_1$| and $\hat{N}_2$ are scaled $$\hat{N}_1' = \frac{\sqrt{P_N}}{\sqrt{(w_3 + aw_4)^2P_S + (w_3^2 + w_4^2)P_N}}\hat{N}_1 \quad \hat{N}_2' = \frac{\sqrt{P_N}}{\sqrt{(w_5 + aw_6)^2P_S + (w_5^2 + w_6^2)P_N}}\hat{N}_2. \tag{Formula 20}$$

Given the previously described signal decomposition, a signal that is similar to the original stereo signal can be obtained by applying [2] at each time and for each subband and converting the subbands back to the time domain.

For generating the signal with modified dialog gain, the subbands are computed as $$Y_1(i,k) = 10^{\frac{g(i,k)}{20}}S(i,k) + N_1(i,k) \quad Y_2(i,k) = 10^{\frac{g(i,k)}{20}}A(i,k)S(i,k) + N_2(i,k), \tag{Formula 21}$$

where g(i,k) is a gain factor in dB which computed such that the dialog gain is modified as desired.

These observations imply g(i,k) is set to 0 dB at very low frequencies and above 8 kHz, to potentially modify the stereo signal as little as possible.

As mentioned in the foregoing description, $X_1$ and $X_2$ indicate let and right input signals of SDV in Formula 2, respectively. And, $Y_1$ and $Y_2$ indicate let and right output signals of the SDV in Formula 21, respectively. Yet, in the inverse-phase mono signal environment where an input has an inverse phase, it becomes $X_2=-X_1$ in left and right input signals of SDV. If this is inserted in a formula and then developed, it becomes $Y_1=X_1$ and $Y_2=X_2$)[A=1]. Consequently, if an input has an opposite phase, a general SDV recognizes a background sound having any speech signal not exist in the input at all and then outputs the input intact.

Yet, the inverse-phase mono signal environment is not a situation having no speech signal at all. Instead, the inverse-phase mono signal environment is generated to force to give a stereo effect or occurs due to error in the course of transmission. Hence, a whole signal is recognized as a speech signal and is then processed.

In order to prevent $X_1$ and $X_2$ from being canceled out in generating $Y_1$ and $Y_2$ in Formula 21, it is necessary to invert a phase of either $X_1$ or $X_2$ or a phase of a gain value corresponding to either $X_1$ or $X_2$.

Using the above formulas, the relation between X and Y can be represented as follows.

$$Y_1(i,k) = 10^{\frac{g(i,k)}{20}}(w_1X_1 + w_2X_3) + (w_3X_1 + w_4X_2) \quad \text{[Formula 22]}$$
$$= \left(10^{\frac{g(i,k)}{20}}w_1 + w_3\right)X1 + (w_2 + w_4)X_2$$
$$Y_2(i,k) = 10^{\frac{g(i,k)}{20}}A(i,k)(w_1X_1 + w_2X_2)X_1 + (w_3X_1 + w_4X_2)$$
$$= \left(10^{\frac{g(i,k)}{20}}A(i,k)w_1 + w_3\right)X1 + (Aw_2 + w_4)X_2$$

In this case, $$10^{\frac{g(i,k)}{20}}w_1 + w_3$$

indicates a gain $X_1Y_1$, $^{w_2+w_4}$ indicates a gain $X_1Y_2$, $$10^{\frac{g(i,k)}{20}}A(i,k)w_1$$

indicates a gain $X_2Y_2$, and $^{Aw_2+w_4}$ indicates a gain $X_2Y_1$.

In Formula 22, since a speech signal is canceled out by adding a phase having the gains $X_1Y_2$ and $X_2Y_1$ inverted to an original phase, it is able to output a non-canceled speech signal by inverting a phase of either $X_1$ or $X_2$ or a phase of a gain.

The present invention relates to a method of independently controlling a speech signal in an input signal having an inverted phase generated from inverting a phase of a gain, by which the present invention is non-limited. In an inverse-phase mono signal environment, if phases of the gains $X_1Y_2$ and $X_2Y_1$ are inverted, $Y_1$ and $Y_2$ can be outputted while phases of $X_1$ and $X_2$ are maintained. Namely, a speech signal can be outputted by being controlled (e.g., a dialog volume is controlled) while an inverse-phase mono signal environment is maintained. On the other hand, if phase of gains $X_2Y_1$ and $X_2Y_2$ are inverted, $Y_1$ and $Y_2$ are outputted as a general mono environment signal having the same phase of the input $X_1$ instead of the inverse-phase mono signal environment. If phases of gains $X_1Y_1$ and $X_1Y_2$ are inverted, $Y_1$ and $Y_2$ are outputted as a general mono environment signal having the same phase of the input $X_2$.

Figure 5:
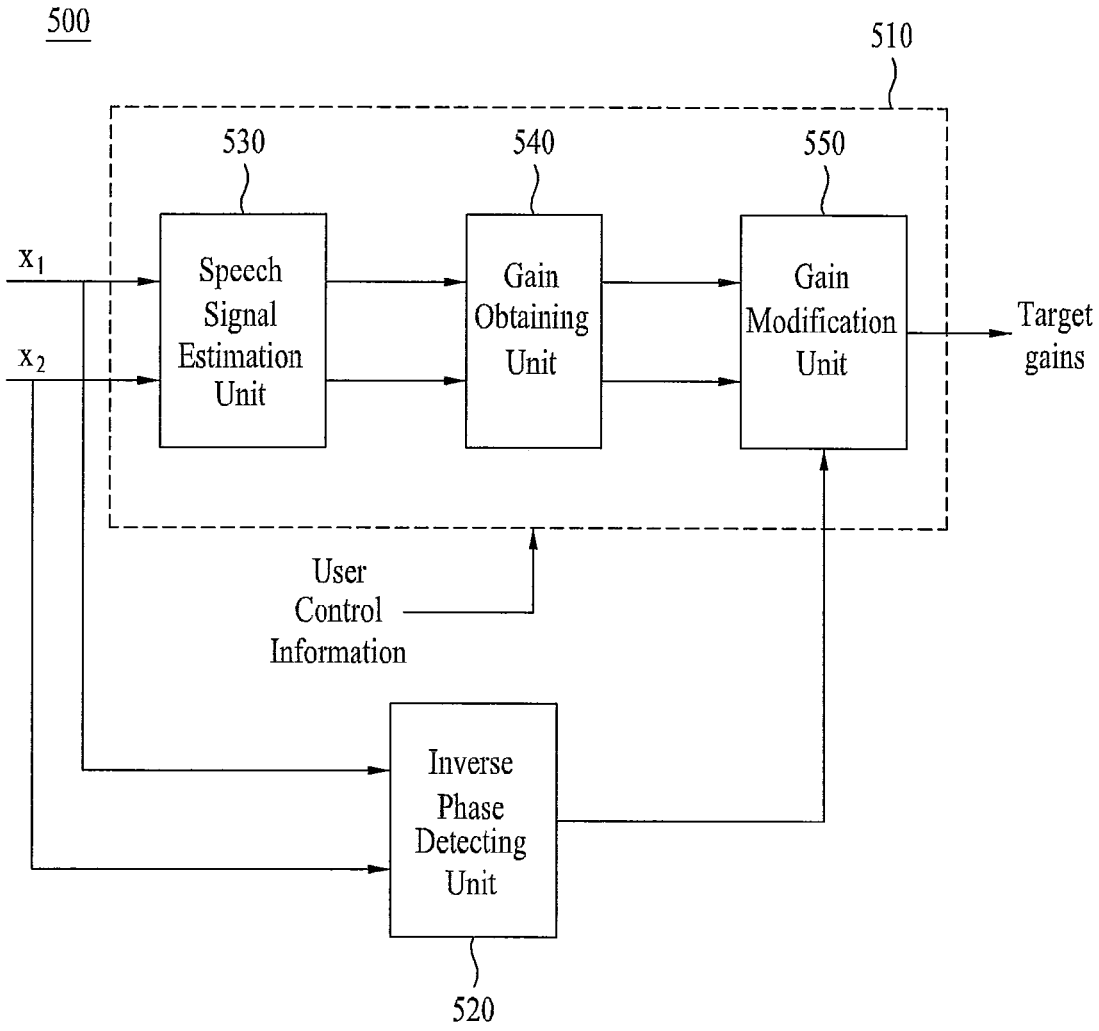
FIG. 5 is a block diagram of a speech signal control system including an inverse phase detecting unit according to an embodiment of the present invention.

FIG. 5 is a block diagram of a speech signal control system including an inverse phase detecting unit according to an embodiment of the present invention.

Referring to FIG. 5, a speech signal is estimated by a speech signal estimation unit 520 using an input signal. A prescribed gain (e.g., a gain set by a user) is applicable to the estimated speech signal. Subsequently, a gain of an output signal is obtained by a gain obtaining unit 540. Meanwhile, it is determined whether an input signal is an inverse-phase mono signal through an inverse phase detecting unit 520. A sign or value of the gain obtained by the gain obtaining unit 540 is modified by a gain modification unit 550. Thus, the speech signal can be modified. For clarity and convenience of description of the present invention, a method of estimating or controlling a speech signal on a whole band of an input audio signal is explained, by which the present invention is non-limited. Namely, according to a prescribed embodiment, the system 500 includes an analysis filterbank, a power estimator, a signal estimator, a post scaling module, a signal synthesis module and a synthesis filterbank. Hence, it may be more efficient if an input audio signal is divided on a plurality of subbands and a speech signal is then estimated per subband by a speech signal estimator [not shown in the drawing]. The elements of the speech signal control system 500 can exist as separated processes. And, processes of at least two or more elements can be combined into one element.

The present invention needs to determine whether an input signal environment is an inverse-phase mono signal environment through the inverse phase detecting unit 520. According to a prescribed embodiment, the inverse phase detecting unit 520 checks inter-channel correlation of an input signal frame per subband. If a sum of them fails to reach a threshold value, the corresponding frame is regarded as an inverse-phase mono signal frame. Alternatively, the inverse phase detecting unit 520 checks inter-channel correlation of an input signal frame per subband. If the subband number, which is negative, is greater than a threshold value, it is able to regard the corresponding frame as an inverse-phase mono signal frame. Furthermore, the above method is usable together.

Figure 6:
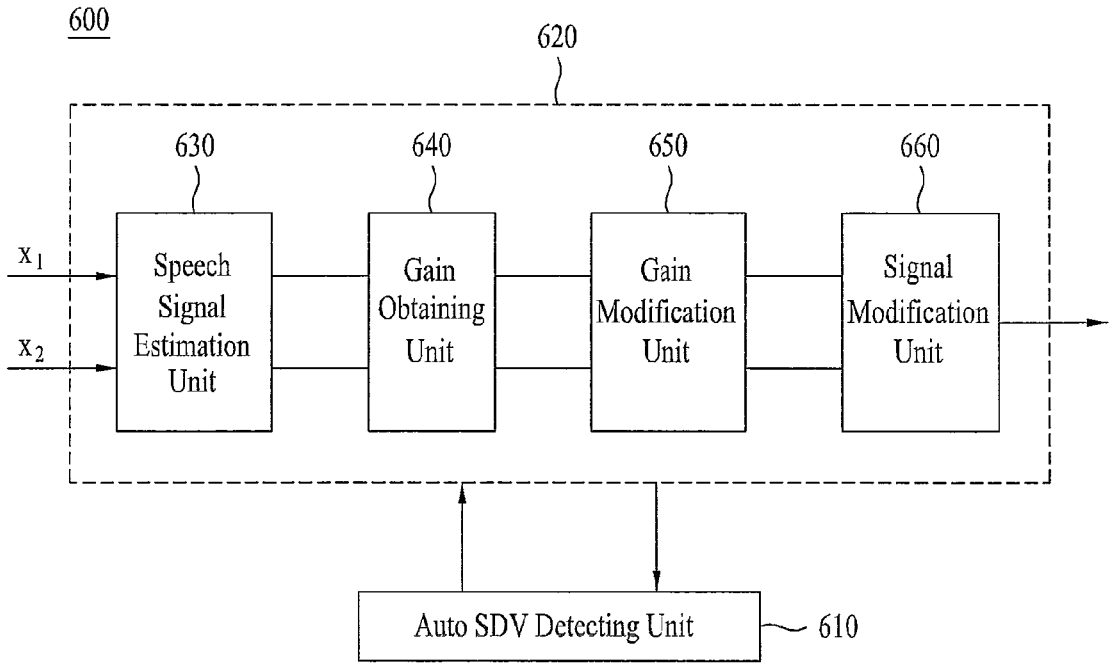
FIG. 6 is a block diagram of a speech signal control system including an auto SDV e detecting unit according to an embodiment of the present invention.

FIG. 6 is a block diagram of a speech signal control system including an auto SDV e detecting unit according to an embodiment of the present invention. If a dialog of an audio signal is considerably greater than a noise component of an audio signal or an outside nose, necessity of SDV is reduced. Hence, it is able to determine a method of SDV operation by automatically determining necessity of the SDV operation. Referring to FIG. 6, the speech signal control system includes an auto SDV detecting unit 610 and an SDV processing unit 620. It is able to vary a presence or non-presence of the SDV operation and an extent of gain by automatically determining the necessity of the SDV operation via the auto SDV detecting unit 610. In particular, a speech signal is estimated by a speech signal estimation unit 630. A gain of an output signal is obtained by a gain obtaining unit 640. And, a gain modification unit 650 changes a sign of a gain or modifies a value of the gain determined by the auto SDV detecting unit 610. And, a signal modification unit 660 can modify the speech signal based on the modified gain.

According to a prescribed embodiment, first of all, the auto SDV detecting unit 610 determines to perform the SDV operation only if a power Pc of a dialog component signal is smaller than a power $P_n$ of a noise component within a signal or a power Ps of an outside noise (it can be limited to a specific ratio). Secondly, the auto SDV detecting unit 610 is able to determine to perform the SDV operation by attaching such a device for measuring an outside noise as a microphone and the like to an outside of an application provided with an SDV device and then measuring an extent of an outside noise obtained through this device. Optionally, the auto SDV detecting unit 610 can use both of the above methods together.

By determining a presence or non-presence of the SDV operation according to the above method, the SDV is activated according to an input signal or a noise extent of an outside environment or an input can be outputted intact. According to an input signal or a value of noise of an outside environment, it is able to vary a value of a gain for a dialog component of an audio signal. An auto SDV method with reference to a power according to an embodiment of the present invention is explained, by which the present invention is non-limited. And, the present invention is able to take other formulas and parameters including absolute values and the like into consideration.

Figure 7:
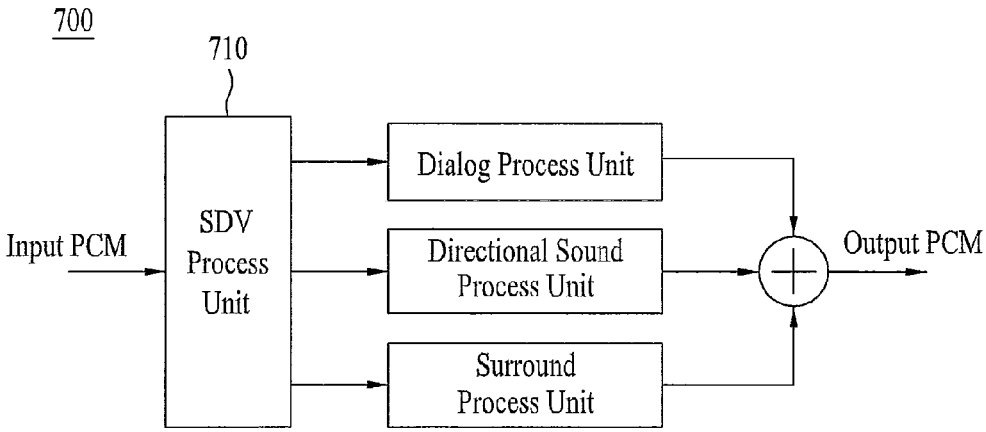
FIG. 7 is a block diagram of an audio signal processing apparatus due to characteristics of a detected sound according to an embodiment of the present invention.

FIG. 7 is a block diagram of an audio signal processing apparatus due to characteristics of a detected sound according to an embodiment of the present invention.

Referring to FIG. 7, independent sound quality reinforcing methods are applicable to a dialog, directional sound and surround sound, which are detected using an SDV process unit 710, respectively. In particular, a signal processing can be differently performed according to a characteristic of a detected sound. For instance, it is able to perform equalization for sound quality reinforcement or sound color change per signal, watermark and other signal processes using a sound discriminated after SDV as an input. In case of a dialog, such a signal process as voice cancellation for commercial and other usages can be performed. In case of a directional sound, such a signal process as sound widening for surround effect enhancement can be performed. In case of a surround sound, such a signal process as 3D sound effect enhancement can be performed. Meanwhile, by obtaining a characteristic of a signal inputted from the SDV process unit 710, it is ale to discriminate a dialog or a directional sound through a frequency, an imaged position or the like. And, the dialog is mostly located at a center due to its characteristics and its position is not changed. In particular, in case that an inter-channel level difference (ICLD) varies less, it is highly possible that an input signal is a dialog.

Figure 8:
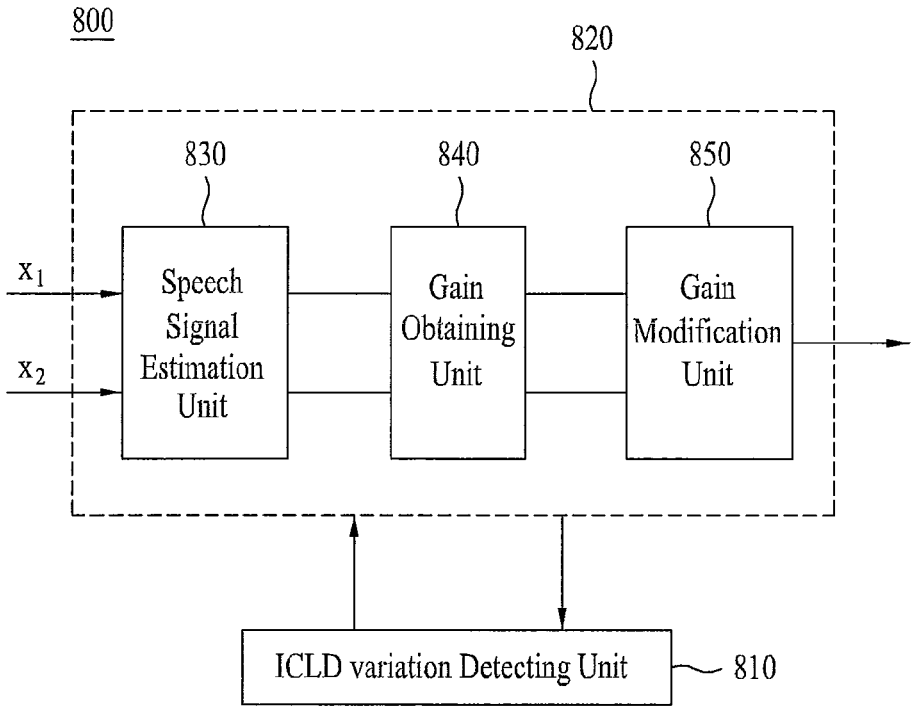
FIG. 8 is a block diagram of a speech signal control system including an ICLD detecting unit according to an embodiment of the present invention.

FIG. 8 is a block diagram of a speech signal control system including an ICLD detecting unit according to an embodiment of the present invention.

Referring to FIG. 8, an SDV process unit 820 calculates an ICLD per band for an input signal frame and then delivers the information to an ICLD variation detecting unit 810. The ICLD variation detecting unit 810 then compares the delivered ICLD information per band of a current frame to per-band ICLD information of a preceding frame. If there is no variation of the ICLD or small variation of the ICLD exists (determined as a dialog), classification of the input signal frame is handed over to the SDV process unit. If the ICLD variation is large, the ICLD variation detecting unit 810 determines that the input signal frame is not the dialog despite that the SDV process unit determines that the input signal frame is a dialog and is then able to use the information for the gain control.

Figure 9:
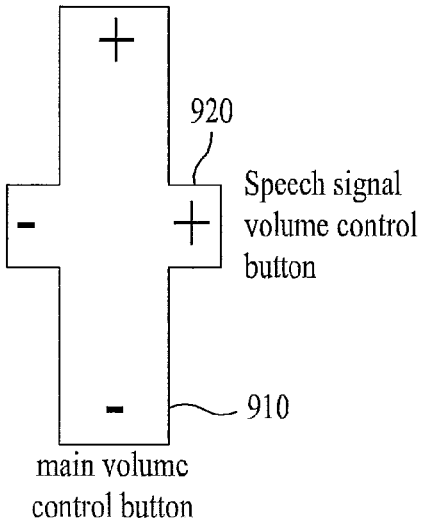
FIG. 9 is a partial diagram of a remote controller including a remote controller volume button having an SDV controller for controlling a dialog volume.

FIG. 9 is a partial diagram of a remote controller including a remote controller volume button having an SDV controller for controlling a dialog volume.

Referring to FIG. 9, a main volume control button 910 for increasing or decreasing a main volume (e.g., a volume of a whole signal) is located top to bottom. And, a speech signal volume control button 920 for increasing or decreasing a volume of such a specific audio signal as a speech signal computed via a speech signal estimation unit can be located right to left. The remote controller volume button is one embodiment of a device for controlling a speech signal volume, by which the present invention is non-limited.

Figure 10:
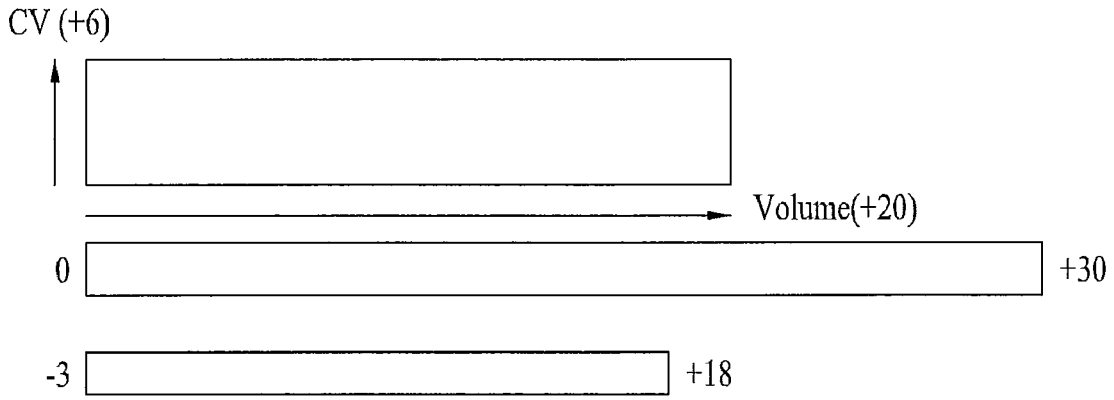
FIG. 10 and FIG. 11 are diagrams for a method of notifying dialog volume control information via OSD (on screen display) of a television receiver.
Figure 11:
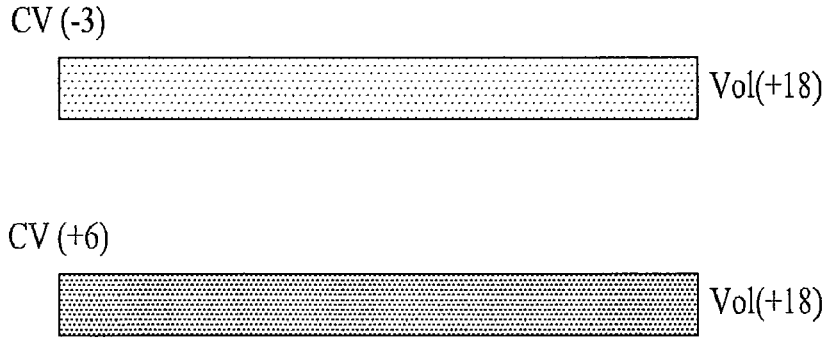

FIG. 10 and FIG. 11 are diagrams for a method of notifying dialog volume control information via OSD (on screen display) of a television receiver.

Referring to FIG. 10, a length of a volume bar indicates a main volume, while a width of the volume bar indicates a level of a dialog volume. In particular, if the length of the volume bar increases more, it may indicate that a level of the main volume is raised higher. If the width of the volume bar increases more, it may mean that a level of the dialog volume is raised higher.

Referring to FIG. 11, a dialog volume level can be represented using a color of a volume bar instead of a width of the volume bar. In particular, if a density of color of a volume bar increases, it may mean that a level of a dialog volume is raised.

Figure 12:
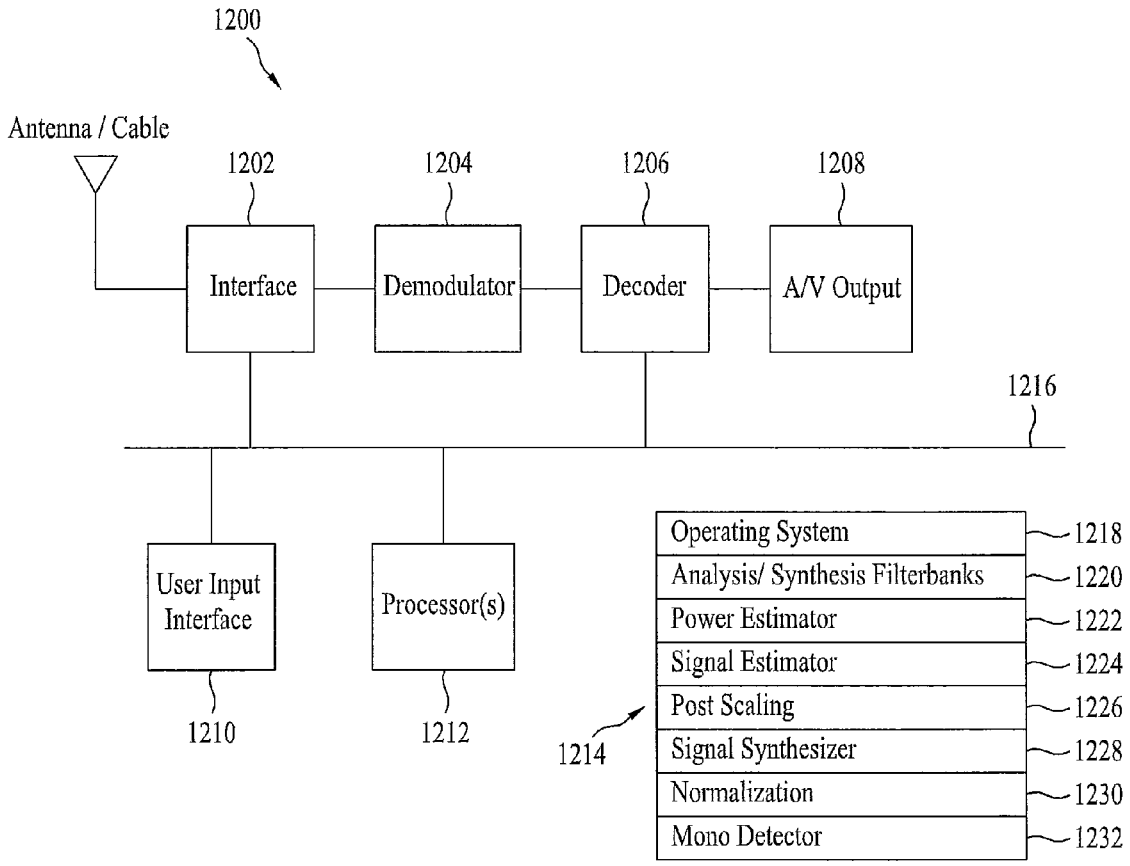
FIG. 12 is a block diagram for an example of a digital television system 1200 performing a dialog amplification technology.

FIG. 12 is a block diagram of an example digital television system 1200 for implementing the features and process described in reference to FIGS. 1-11. Digital television (DTV) is a telecommunication system for broadcasting and receiving moving pictures and sound by means of digital signals. DTV uses digital modulation data, which is digitally compressed and requires decoding by a specially designed television set, or a standard receiver with a set-top box, or a PC fitted with a television card. Although the system in FIG. 12 is a DTV system, the disclosed implementations for dialog enhancement can also be applied to analog TV systems or any other systems capable of dialog enhancement.

In some implementations, the system 1200 can include an interface 1202, a demodulator 1204, a decoder 1206, and audio/visual output 1208, a user input interface 1210, one or more processors 1212 and one or more computer readable mediums 1214 (e.g., RAM, ROM, SDRAM, hard disk, optical disk, flash memory, SAN, etc.). Each of these components are coupled to one or more communication channels 1216 (e.g., buses). In some implementations, the interface 1202 includes various circuits for obtaining an audio signal or a combined audio/video signal. For example, in an analog television system an interface can include antenna electronics, a tuner or mixer, a radio frequency (RF) amplifier, a local oscillator, an intermediate frequency (IF) amplifier, one or more filters, a demodulator, an audio amplifier, etc. Other implementations of the system 1200 are possible, including implementations with more or fewer components.

The tuner 1202 can be a DTV tuner for receiving a digital televisions signal including video and audio content. The demodulator 1204 extracts video and audio signals from the digital television signal. If the video and audio signals are encoded (e.g., MPEG encoded), the decoder 1206 decodes those signals. The A/V output can be any device capable of display video and playing audio (e.g., TV display, computer monitor, LCD, speakers, audio systems).

In some implementations, dialog volume levels can be displayed to the user using a display device on a remote controller or an On Screen Display (OSD), for example, and the user input interface can include circuitry (e.g., a wireless or infrared receiver) and/or software for receiving and decoding infrared or wireless signals generated by a remote controller. A remote controller can include a separate dialog volume control key or button, or a master volume control button and dialog volume control button described in reference to FIGS. 10-11.

In some implementations, the one or more processors can execute code stored in the computer-readable medium 1214 to implement the features and operations 1218, 1220, 1222, 1226, 1228, 1230 and 1232.

The computer-readable medium further includes an operating system 1218, analysis/synthesis filterbanks 1220, a power estimator 1222, a signal estimator 1224, a post-scaling module 1226 and a signal synthesizer 1228.

While the present invention has been described and illustrated herein with reference to the preferred embodiments thereof, it will be apparent to those skilled in the art that various modifications and variations can be made therein without departing from the spirit and scope of the invention. Thus, it is intended that the present invention covers the modifications and variations of this invention that come within the scope of the appended claims and their equivalents.

Accordingly, the present invention provides the following effects or advantages.

First of all, in an inverse-phase input audio signal, it is able to control a volume of a speech signal by changing a sign of a final gain or adjusting a value of the final gain corresponding to one channel of left and right channel of the audio signal.

Secondly, in an inverse-phase input audio signal, it is able to control a volume of a speech signal by inverting a phase of either a left or right channel of the audio signal.

Thirdly, by determining an inter-channel correlation of an input audio signal, it is able to check whether a phase of the input audio signal is inverted.

Fourthly, by automatically controlling a timing point of activating SDV, it is able to independently control a volume of a speech signal.

The invention claimed is:

1. A method for processing an audio signal, comprising:

obtaining, with an audio decoding apparatus, a stereophonic audio signal including a speech component signal and other component signals;

obtaining, with the audio decoding apparatus, gain values for each channel of the audio signal;

determining, with the audio decoding apparatus, whether the audio signal is an inverse-phase mono signal including left and right channel whose phase is inverted;

inverting, with the audio decoding apparatus, a phase of the obtained gain value corresponding to the one channel of the audio signal when the audio signal is an inverse-phase mono signal;

modifying, with the audio decoding apparatus, the speech component signal based on the inverted phase of the gain value; and generating, with the audio decoding apparatus, a modified audio signal including the modified speech component signal, wherein the modified audio signal is in-phase mono signal.

2. The method of claim 1, wherein the modified audio signal is inverse-phase mono signal.

3. The method of claim 1, wherein the determining further comprising:

determining, with the audio decoding apparatus, inter-channel correlation between two channels of the audio signal;

comparing, with the audio decoding apparatus, one or more threshold values with the inter-channel correlation; and determining, with the audio decoding apparatus, whether the audio signal is an inverse-phase mono signal based on results of the comparison.

4. The method of claim 3, wherein the inter-channel correlation is determined per sub-band, and the audio signal is an inverse-phase mono signal if a sum of the inter-channel correlations is smaller than one or more threshold.

5. The method of claim 1, wherein the determining further comprising:

determining, with the audio decoding apparatus, inter-channel correlation between two channels of the audio signal;

comparing, with the audio decoding apparatus, one or more threshold values with the number of the inter-channel correlation which is minus; and determining, with the audio decoding apparatus, whether the audio signal is an inverse-phase mono signal based on results of the comparison.

6. The method of claim 5, wherein the inter-channel correlation is determined per sub-band, and the audio signal is an inverse-phase mono signal if the number of the inter-channel correlation which is minus is larger than one or more threshold.

7. The method of claim 2, wherein the determining further comprising:

determining inter-channel correlation between two channels of the audio signal;

comparing one or more threshold values with the inter-channel correlation; and determining whether the audio signal is an inverse-phase mono signal based on results of the comparison.

8. The method of claim 2, wherein the determining further comprising:

determining inter-channel correlation between two channels of the audio signal;

comparing one or more threshold values with the number of the inter-channel correlation which is minus; and determining whether the audio signal is an inverse-phase mono signal based on results of the comparison.

9. A method for processing an audio signal, the method comprising:

obtaining, with an audio decoding apparatus, a stereophonic audio signal including a speech component signal and other component signals;

determining, with the audio decoding apparatus, whether the audio signal is an inverse-phase mono signal including left and right channel whose phase is inverted;

inverting, with the audio decoding apparatus, a phase of the one channel of the audio signal when the audio signal is an inverse-phase mono signal;

obtaining, with the audio decoding apparatus, gain values for each channel of the audio signal;

modifying, with the audio decoding apparatus, the speech component signal based on the obtained gain values; and generating, with the audio decoding apparatus, a modified audio signal including the modified speech component signal, wherein the modified audio signal is in-phase mono signal.

10. The method of claim 9, wherein the determining further comprising:

determining, with the audio decoding apparatus, inter-channel correlation between two channels of the audio signal;

comparing, with the audio decoding apparatus, one or more threshold values with the inter-channel correlation; and determining, with the audio decoding apparatus, whether the audio signal is an inverse-phase mono signal based on results of the comparison.

11. The method of claim 10, wherein the inter-channel correlation is determined per sub-band, and the audio signal is an inverse-phase mono signal if a sum of the inter-channel correlations is smaller than one or more threshold.

12. The method of claim 9, wherein the determining further comprising:

determining, with the audio decoding apparatus, inter-channel correlation between two channels of the audio signal;

comparing, with the audio decoding apparatus, one or more threshold values with the number of the inter-channel correlation which is minus; and determining, with the audio decoding apparatus, whether the audio signal is an inverse-phase mono signal based on results of the comparison.

13. The method of claim 12, wherein the inter-channel correlation is determined per sub-band, and the audio signal is an inverse-phase mono signal if the number of the inter-channel correlation which is minus is larger than one or more threshold.

* * * * *